US011177091B1

(12) United States Patent
Tsai et al.

(10) Patent No.: US 11,177,091 B1
(45) Date of Patent: Nov. 16, 2021

(54) KEYBOARD DEVICE

(71) Applicant: Primax Electronics Ltd., Taipei (TW)

(72) Inventors: Lei-Lung Tsai, Taipei (TW); Chuang-Shu Jhuang, Taipei (TW); Song-Hui Han, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/081,599

(22) Filed: Oct. 27, 2020

(30) Foreign Application Priority Data

Sep. 11, 2020 (CN) ..... 202010951732.4

(51) Int. Cl.
*H01H 13/70* (2006.01)
*H01H 13/7065* (2006.01)

(52) U.S. Cl.
CPC ..... *H01H 13/7065* (2013.01); *H01H 2233/07* (2013.01)

(58) Field of Classification Search
CPC ..... H01H 13/7065; H01H 2233/07; H01H 13/14; H01H 13/704; H01H 13/70
USPC ..... 200/5 A, 344
See application file for complete search history.

(56) References Cited

U.S. PATENT DOCUMENTS

2018/0025862 A1* 1/2018 Chen ..... G06F 3/0202 200/5 A

* cited by examiner

*Primary Examiner* — Edwin A. Leon
*Assistant Examiner* — Iman Malakooti
(74) *Attorney, Agent, or Firm* — Kirton McConkie; Evan R Wilt

(57) ABSTRACT

A keyboard device includes a base plate, a membrane circuit board and a key. The key includes a keycap, a connecting assembly, a first stabilizer bar and a second stabilizer bar. The connecting assembly is connected between the keycap and the base plate. The first stabilizer bar and the second stabilizer bar are connected between the keycap and the connecting assembly. While the keycap is moved upwardly or downwardly relative to the base plate, the first stabilizer bar and the second stabilizer bar are swung to stabilize the key. Since the first stabilizer bar and the second stabilizer bar are connected between the keycap and the connecting assembly, the first stabilizer bar and the second stabilizer bar will not readily collide with or knock on the base plate. During the operation, the generated noise is reduced. Consequently, the operating comfort to the user is enhanced.

11 Claims, 16 Drawing Sheets

KEYBOARD DEVICE

FIELD OF THE INVENTION

The present invention relates to an input device, and more particularly to a keyboard device.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices.

The structures and the functions of a conventional keyboard device 1 will be illustrated as follows. Please refer to FIGS. 1, 2 and 3. FIG. 1 is a schematic top view illustrating the outer appearance of a conventional keyboard device. FIG. 2 is a schematic exploded view illustrating a portion of the keyboard device of FIG. 1 and taken along a viewpoint. FIG. 3 is a schematic exploded view illustrating a portion of the keyboard device of FIG. 1 and taken along another viewpoint. For succinctness, only one key 10' and related components are shown in FIGS. 2 and 3.

The conventional keyboard device 1 comprises plural keys 10 and 10', a base plate 11 and a membrane circuit board 12. The membrane circuit board 12 comprises plural membrane switches 121 corresponding to the plural keys 10 and 10'. Each of the plural keys 10 and 10' comprises a keycap 101, at least one scissors-type connecting element 102 and an elastic element 103. The scissors-type connecting element 102 is connected between the keycap 101 and the base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The elastic element 103 is arranged between the keycap 101 and the membrane circuit board 12. Moreover, the elastic element 103 comprises a contacting part 1031.

While the keycap 101 of any key 10 or 10' is depressed and moved downwardly relative to the base plate 11, the first frame 1021 and the second frame 1022 of the scissors-type connecting element 102 are switched from an open-scissors state to a stacked state. Moreover, as the keycap 101 is moved downwardly to compress the elastic element 103, the corresponding membrane switch 121 is pushed and triggered by the contacting part 1031 of the elastic element 103. Consequently, the keyboard device 1 generates a corresponding key signal. When the key 10 or 10' is no longer depressed, the keycap 101 is moved upwardly relative to the base plate 11 in response to an elastic force of the elastic element 103. Meanwhile, the first frame 1021 and the second frame 1022 are switched from the stacked state to the open-scissors state again, and the keycap 101 is returned to its original position.

As shown in the drawings, the length L1 of the key 10' is much larger than the width W1 of the key 10'. The key 10' further comprises two stabilizer bars 104. Each stabilizer bar 104 comprises a transverse bar part 1041 and two hook parts 1042. The two hook parts 1042 are located at two ends of the transverse bar part 1041, respectively.

The base plate 11 comprises a first connecting structure 111 and a second connecting structure 112. The first connecting structure 111 and the second connecting structure 112 are protruded upwardly, and penetrated through the membrane circuit board 12. The first connecting structure 111 comprises two first locking holes 1111. The second connecting structure 112 comprises two second locking holes 1121 corresponding to the two first locking holes 1111.

The transverse bar part 1041 of the stabilizer bar 104 is pivotally coupled to the keycap 101 of the key 10'. The two hook parts 1042 of the stabilizer bar 104 are penetrated through the corresponding first locking hole 1111 of the first connecting structure 111 and the corresponding second locking hole 1121 of the second connecting structure 112, respectively.

FIG. 4 schematically illustrates the actions of the stabilizer bar of the keyboard device as shown in FIG. 1. While the keycap 101 of the key 10' is moved upwardly or downwardly relative to the base plate 11, the stabilizer bar 104 is moved in the direction D11 or the direction D12 and rotated in the direction D13 or the direction D14. By this design, the key 10' is kept stable and not inclined while the key 10' is moved upwardly or downwardly relative to the base plate 11. Moreover, this design is helpful to increase the strength of the keycap 101.

However, the conventional keyboard device 1 still has some drawbacks. While the keycap 101 of the key 10' is depressed and moved downwardly relative to the base plate 11, the two first hook parts 1042 of the stabilizer bar 104 readily collide with or knock on the base plate 11, the first connecting structure 111 and the second connecting structure 112. Since all of the stabilizer bar 104, the base plate 11, the first connecting structure 111 and the second connecting structure 112 are made of metallic material, the above actions between the metallic components result in the collision sound or the click sound. The collision sound or the click is unpleasant noise to the user.

In other words, the conventional keyboard device needs to be further improved.

SUMMARY OF THE INVENTION

An object of the present invention provides a keyboard device having a function of reducing noise. The keyboard device includes a keycap, a connecting assembly and a base plate. The stabilizer bars of the key are connected between the keycap and the connecting assembly. Since the stabilizer bars do not readily collide with or knock on the plate body and the base coupling structure of the base plate, the generated noise is reduced during the process of operating the key. Consequently, the operating comfort to the user is enhanced. In comparison with the conventional keyboard device, the base plate of the keyboard device of the present invention can be manufacture and assembled more easily.

In accordance with an aspect of the present invention, there is provided a keyboard device. The keyboard device includes a membrane circuit board, a base plate and a key. The membrane circuit board includes a membrane switch. The key includes a keycap, a connecting assembly, a first stabilizer bar and a second stabilizer bar. The keycap is located over the membrane circuit board. When the keycap is moved downwardly relative to the membrane circuit board, the membrane switch is triggered. The connecting assembly is connected between the keycap and the base plate. The first stabilizer bar is connected between the keycap and the connecting assembly. The second stabilizer bar is connected between the keycap and the connecting assembly. While the keycap is moved upwardly or downwardly relative to the membrane circuit board, the first stabilizer bar and the second stabilizer are swung to stabilize the key.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
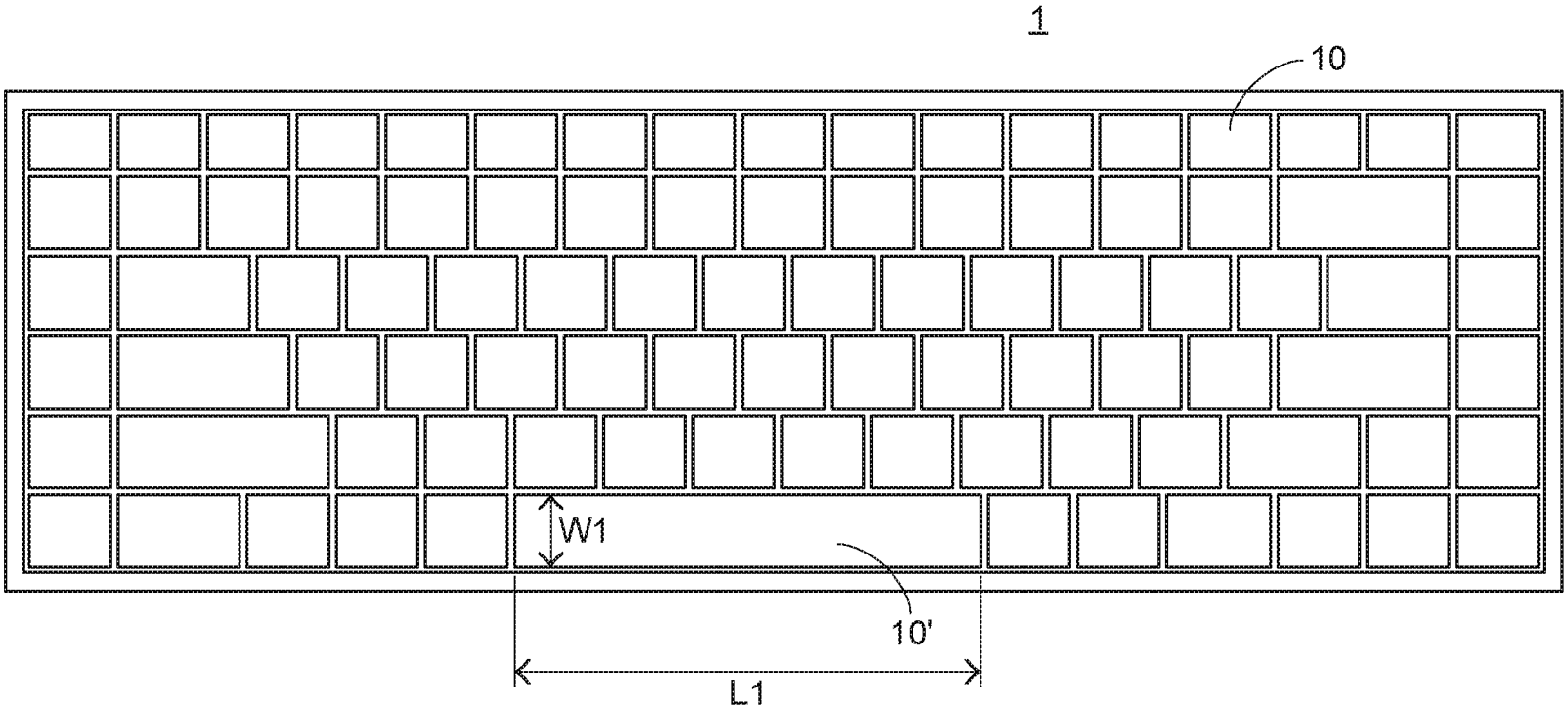
FIG.1 PRIOR ART
FIG. 1 is a schematic top view illustrating the outer appearance of a conventional keyboard device.
Figure 2:
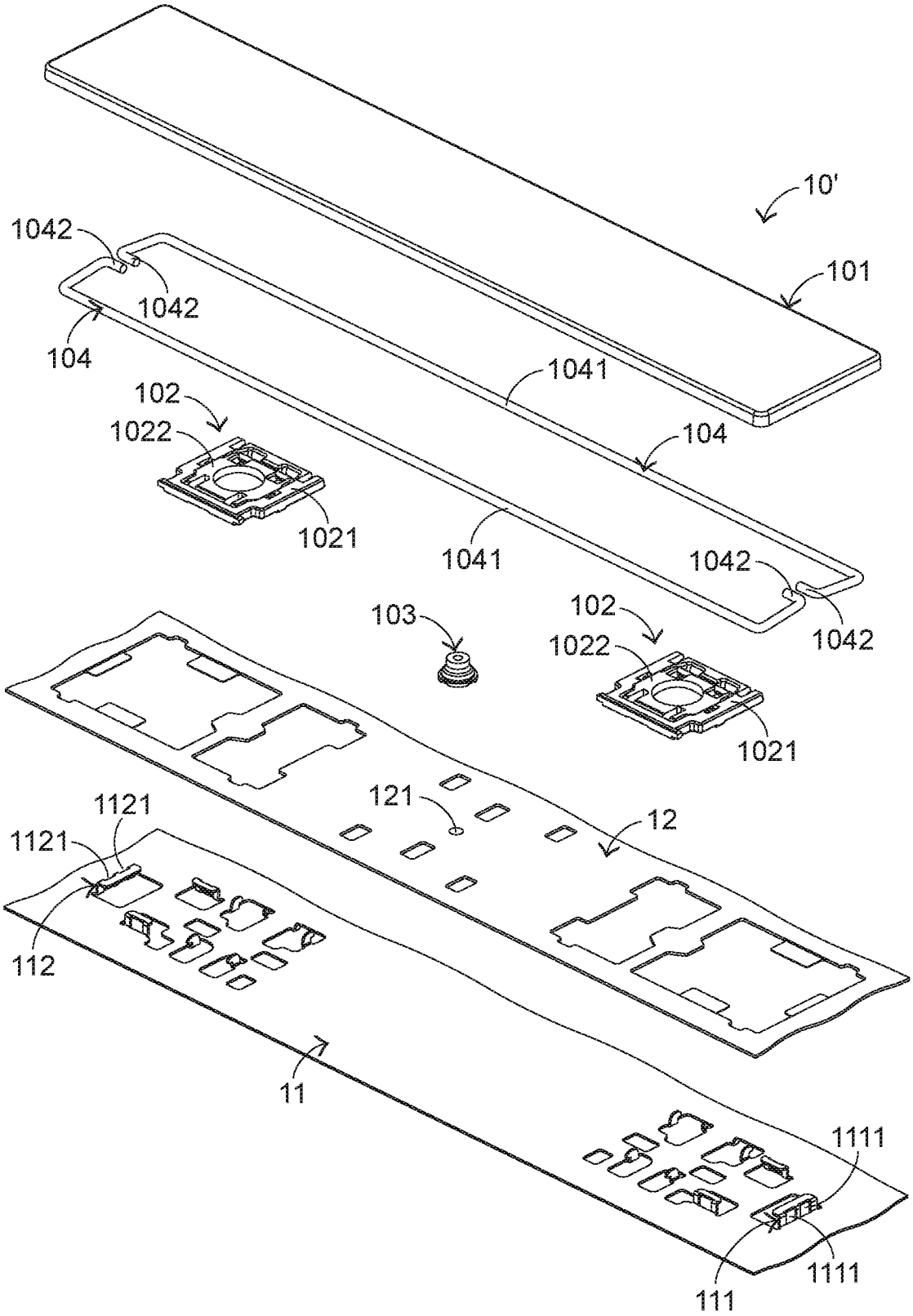
FIG.2 PRIOR ART
FIG. 2 is a schematic exploded view illustrating a portion of the keyboard device of FIG. 1 and taken along a viewpoint.
Figure 3:
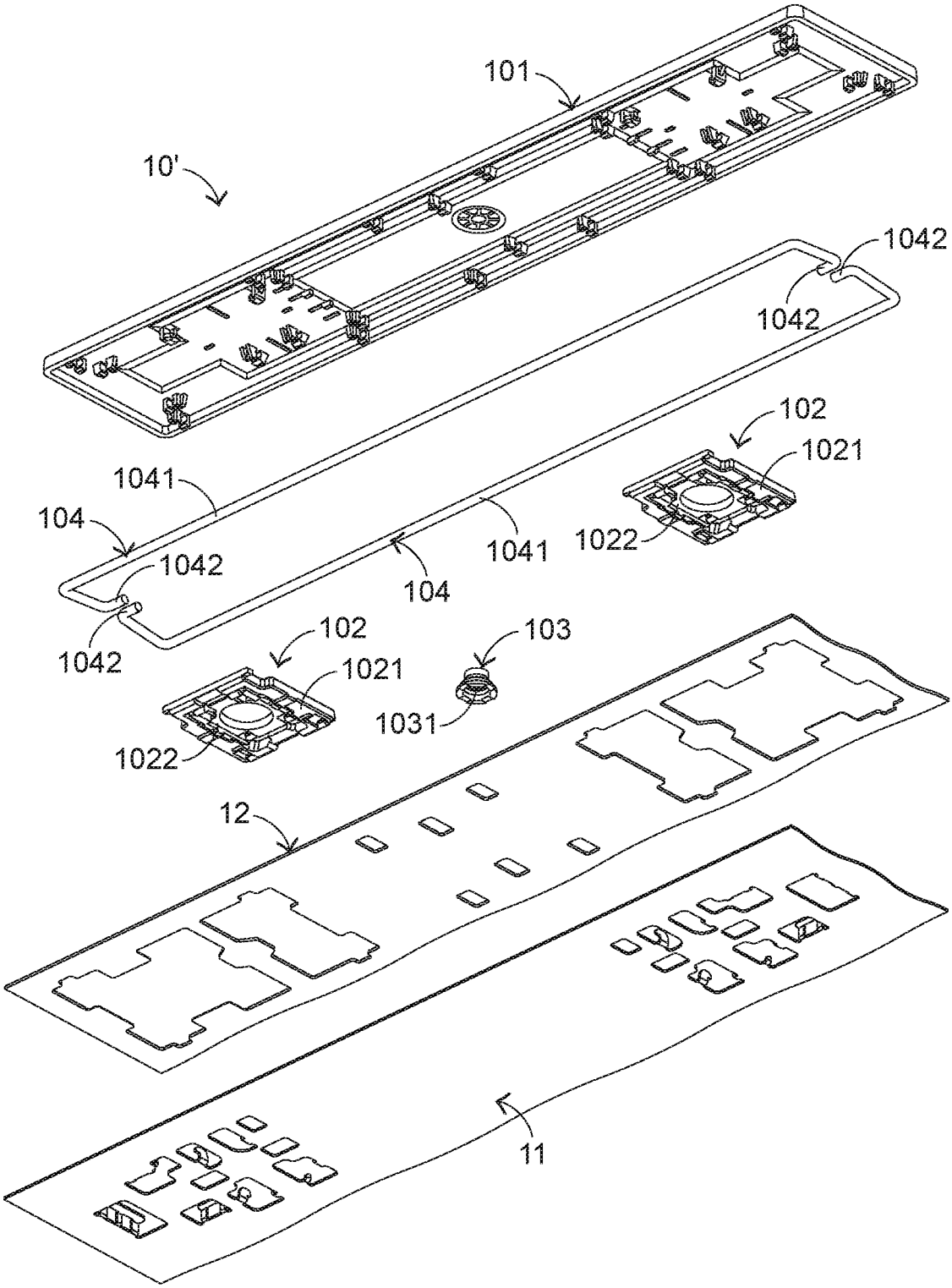
FIG.3 PRIOR ART
FIG. 3 is a schematic exploded view illustrating a portion of the keyboard device of FIG. 1 and taken along another viewpoint.
Figure 4:
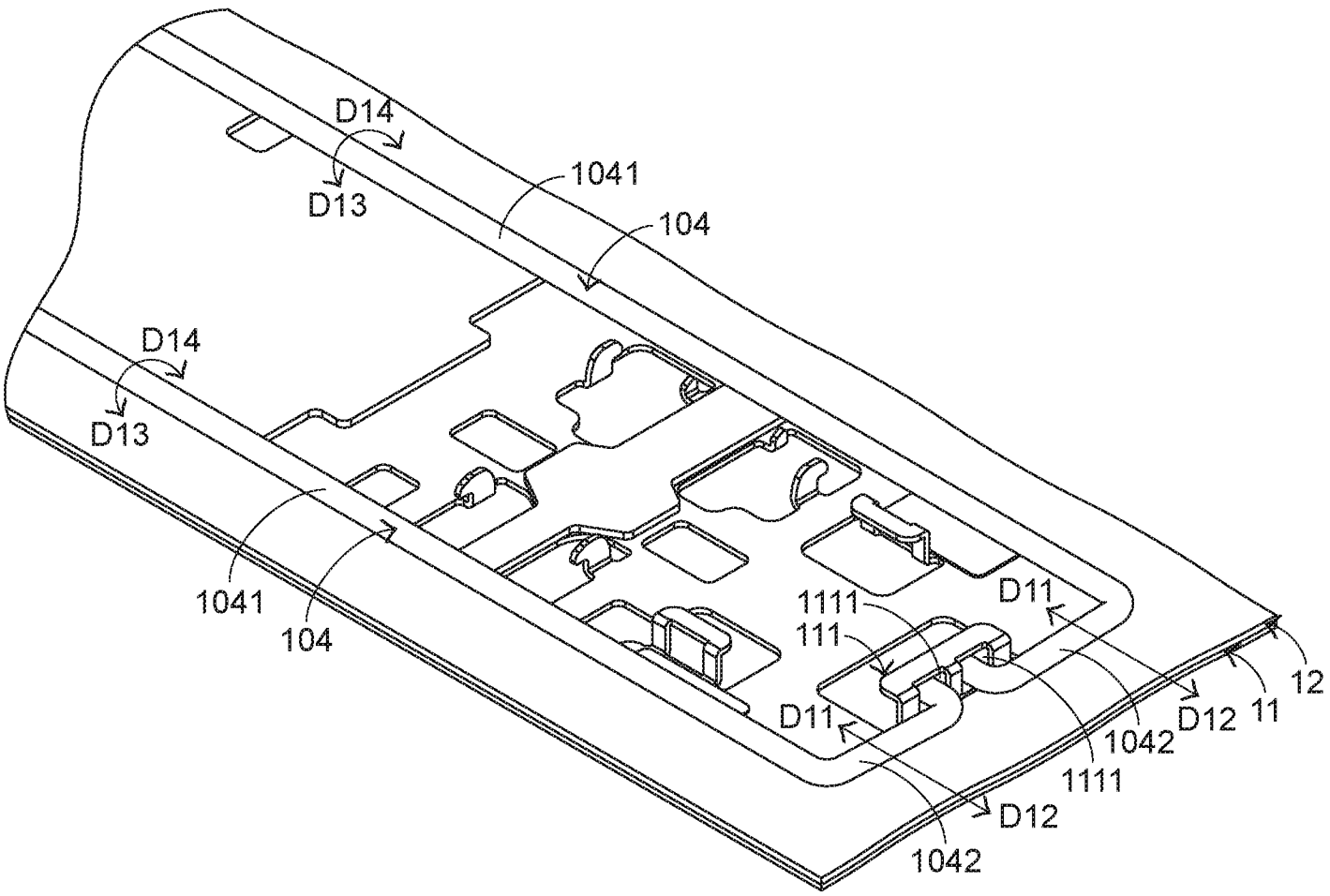
FIG.4 PRIOR ART
FIG. 4 schematically illustrates the actions of the stabilizer bar of the keyboard device as shown in FIG. 1.

The embodiments of present invention will be described more specifically with reference to the following drawings. Generally, in the drawings and specifications, identical or similar components are designated by identical numeral references. For well understanding the present invention, the elements shown in the drawings are not in scale with the elements of the practical product. In the following embodiments and drawings, the elements irrelevant to the concepts of the present invention or the elements well known to those skilled in the art are omitted. It is noted that numerous modifications and alterations may be made while retaining the teachings of the invention.

Figure 5:
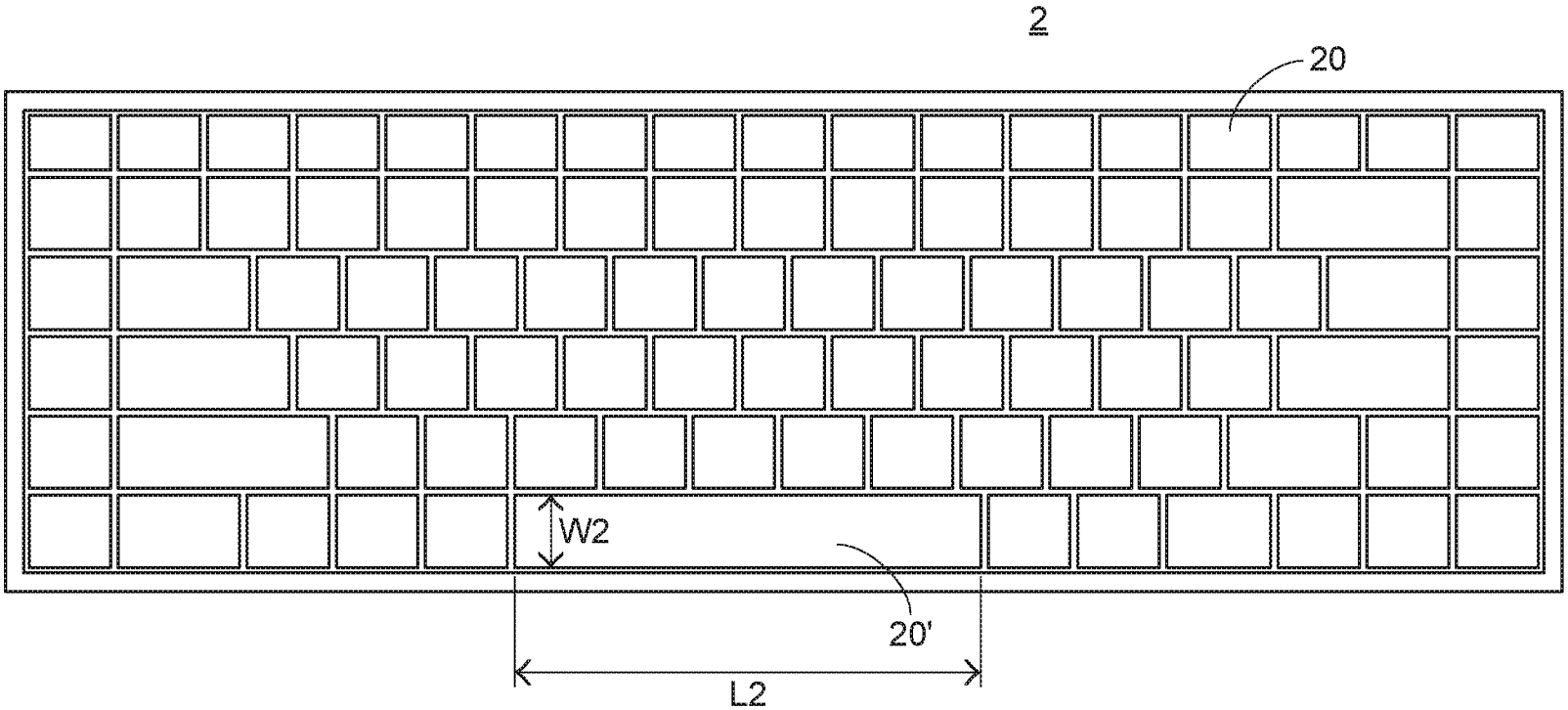
FIG. 5 is a schematic top view illustrating the outer appearance of a keyboard device according to a first embodiment of the present invention.
Figure 6:
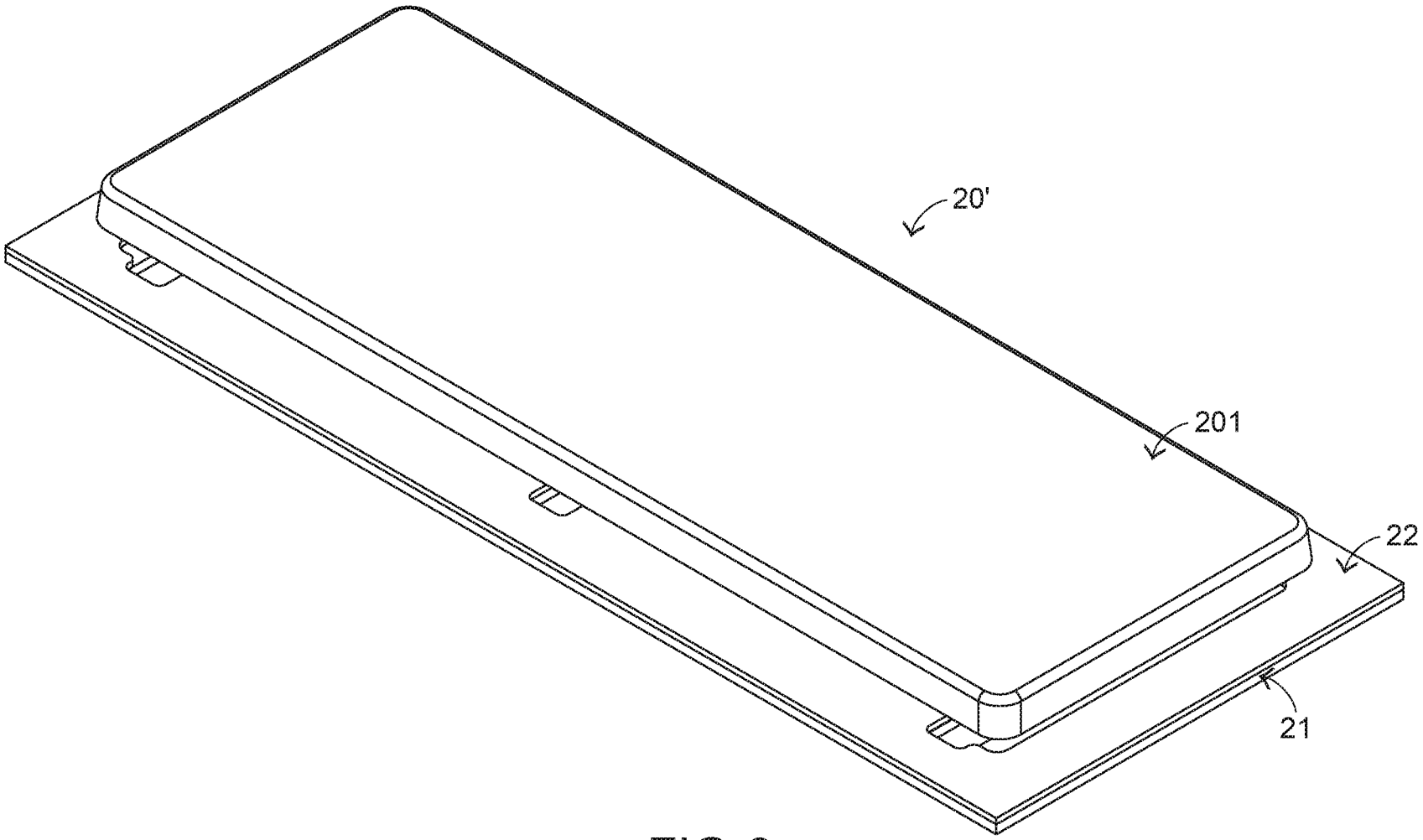
FIG. 6 is a schematic perspective view illustrating the appearance of a key, a base plate and a membrane circuit board of the keyboard device as shown in FIG. 5.
Figure 7:
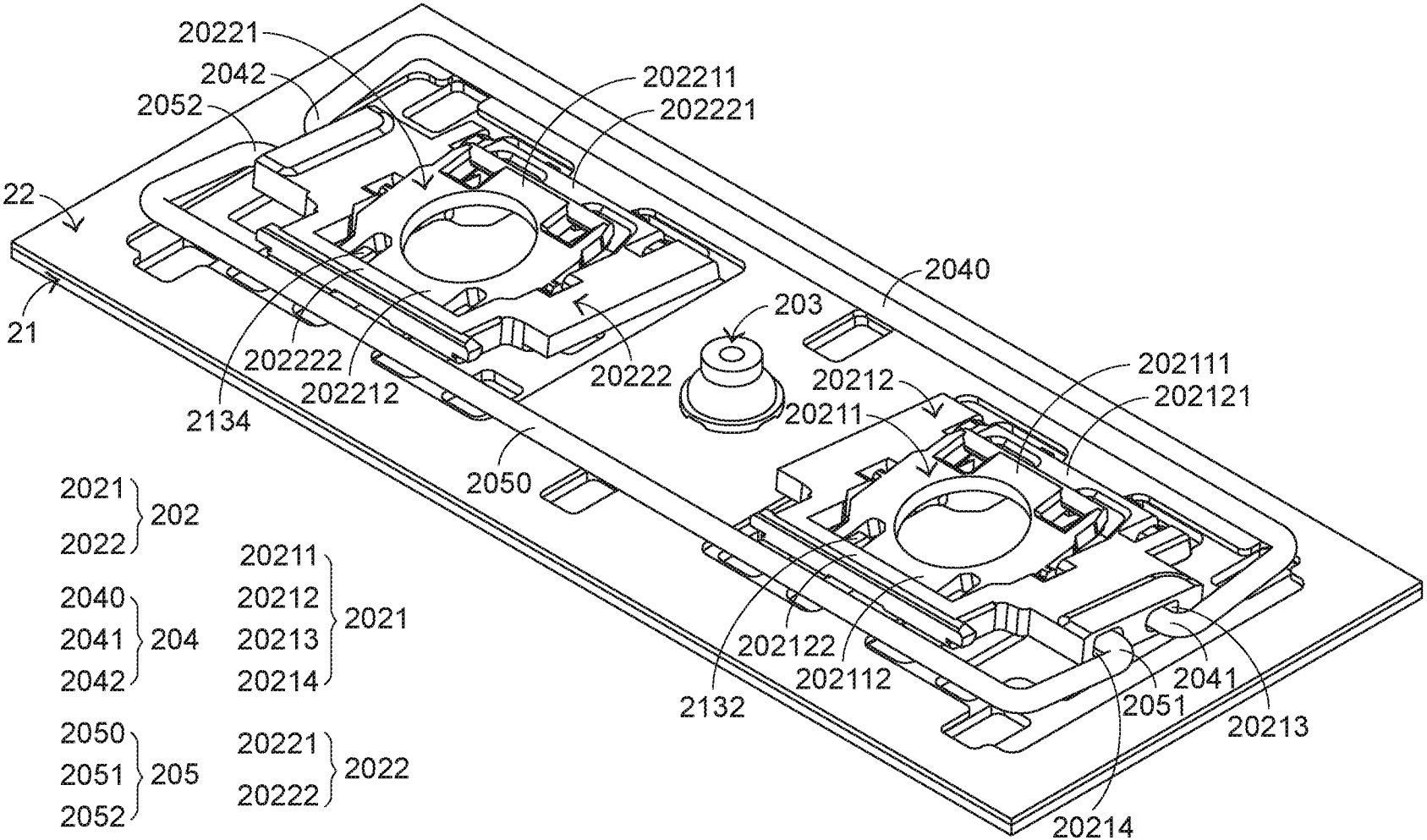
FIG. 7 is a schematic perspective view illustrating portions of the key, the base plate and the membrane circuit board of the keyboard device as shown in FIG. 6 and taken along a viewpoint.
Figure 8:
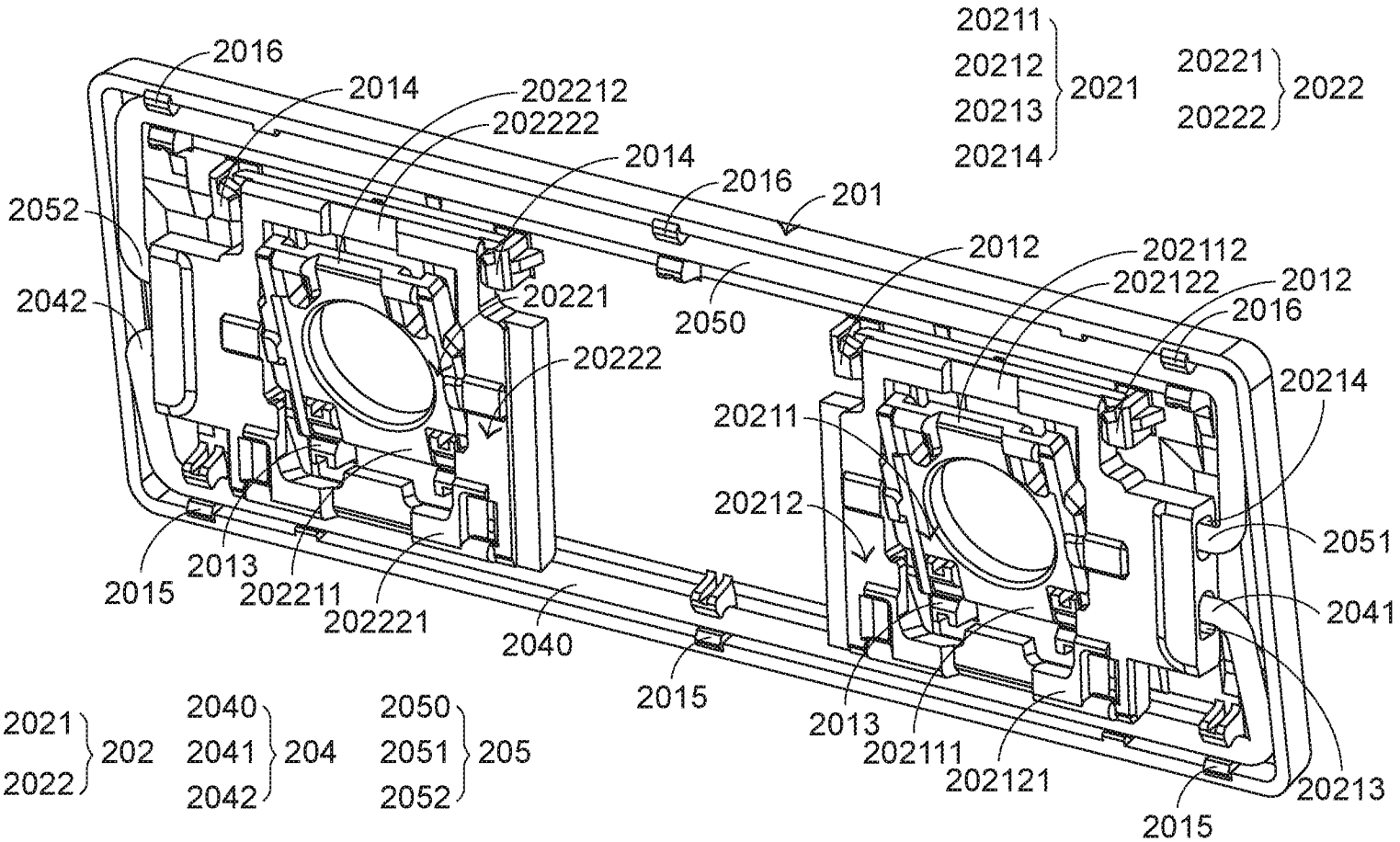
FIG. 8 is a schematic perspective view illustrating a portion of the key of the keyboard device as shown in FIG. 6 and taken along a viewpoint.
Figure 9:
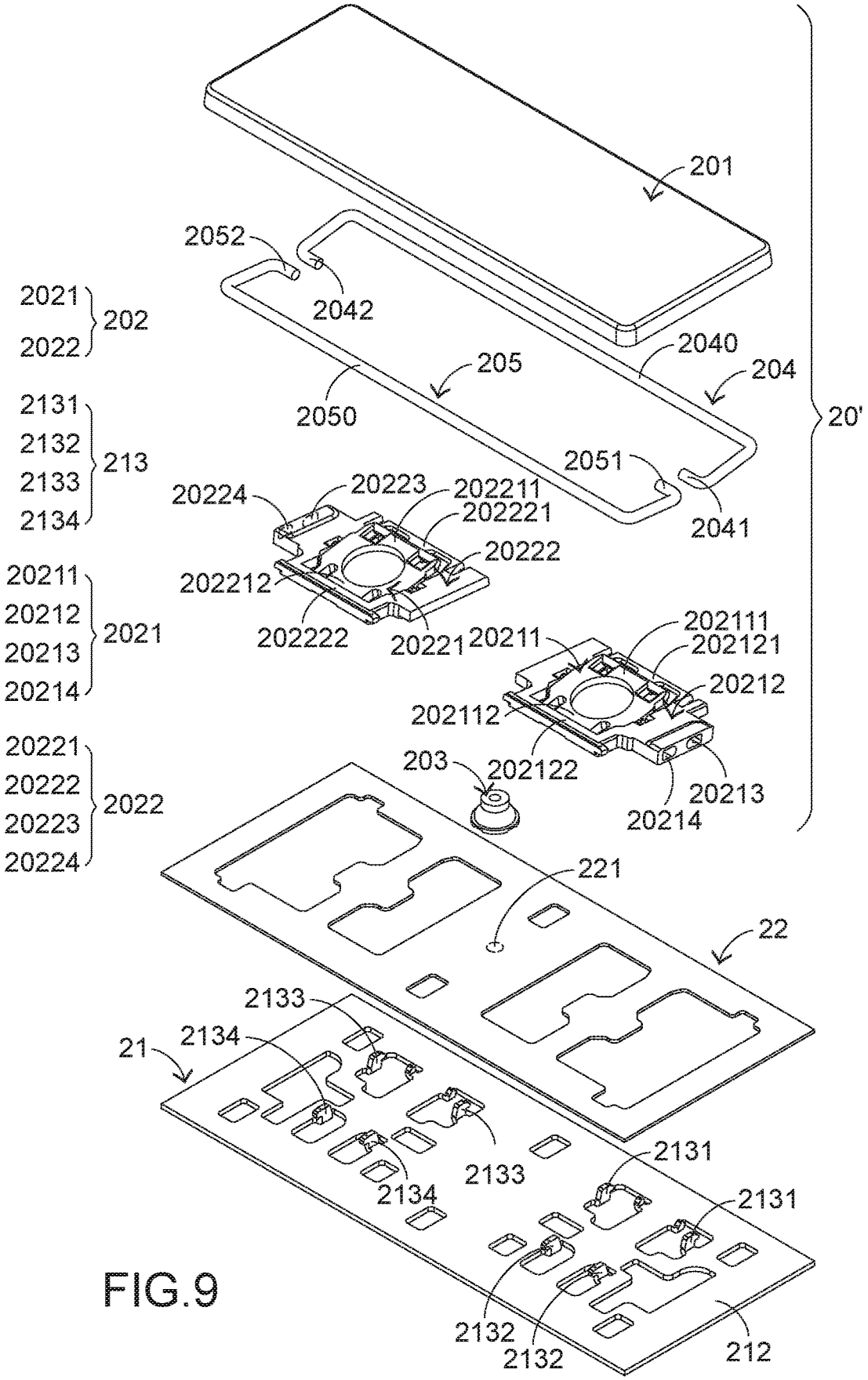
FIG. 9 is a schematic exploded view illustrating portions of the key, the base plate and the membrane circuit board of the keyboard device as shown in FIG. 6 and taken along a viewpoint.
Figure 10:
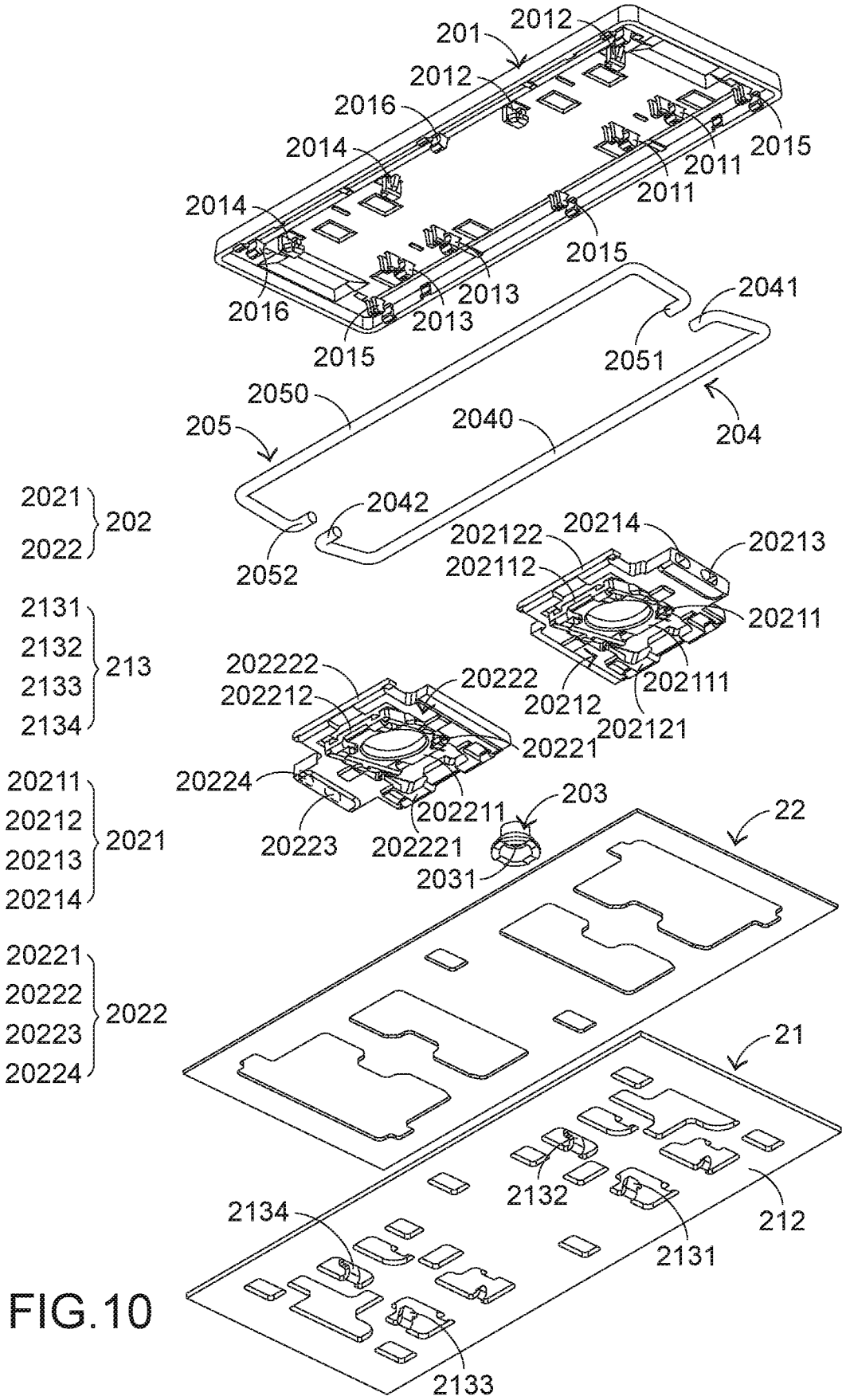
FIG. 10 is a schematic exploded view illustrating portions of the key, the base plate and the membrane circuit board of the keyboard device as shown in FIG. 9 and taken along another viewpoint.

Please refer to FIGS. 5, 6, 7, 8, 9 and 10. FIG. 5 is a schematic top view illustrating the outer appearance of a keyboard device according to a first embodiment of the present invention. FIG. 6 is a schematic perspective view illustrating the appearance of a key, a base plate and a membrane circuit board of the keyboard device as shown in FIG. 5. FIG. 7 is a schematic perspective view illustrating portions of the key, the base plate and the membrane circuit board of the keyboard device as shown in FIG. 6 and taken along a viewpoint. FIG. 8 is a schematic perspective view illustrating a portion of the key of the keyboard device as shown in FIG. 6 and taken along a viewpoint. FIG. 9 is a schematic exploded view illustrating portions of the key, the base plate and the membrane circuit board of the keyboard device as shown in FIG. 6 and taken along a viewpoint. FIG. 10 is a schematic exploded view illustrating portions of the key, the base plate and the membrane circuit board of the keyboard device as shown in FIG. 9 and taken along another viewpoint. For succinctness, only one key 20' and related components are shown in FIGS. 6, 7, 8, 9 and 10.

The keyboard device 2 comprises plural keys 20 and 20', a base plate 21 and a membrane circuit board 22. The membrane circuit board 22 is arranged between the plural keys 20, 20' and the base plate 21. These keys 20 and 20' are classified into some types, e.g., ordinary keys, numeric keys and function keys. When one of the keys 20 and 20' is depressed by the user's finger, the keyboard device 2 generates a corresponding key signal to a computer (not show), and thus the computer executes a function corresponding to the depressed key. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

The base plate 21 comprises a plate body 212 and plural base coupling structures 213. The plate body 212 is located under the membrane circuit board 22. The base coupling structures 213 are protruded upwardly and penetrated through the membrane circuit board 22. The membrane circuit board 22 comprises plural membrane switches 221 corresponding to the keys 20 and 20'.

Each key 20' comprises a keycap 201, a connecting assembly 202 and an elastic element 203. The connecting assembly 202 comprises a first connecting element 2021 and a second connecting element 2022, which are discretely arranged. The first connecting element 2021 and the second connecting element 2022 are connected between the keycap 201 and the base coupling structures 213. Through the connecting assembly 202, the keycap 201 is moved upwardly or downwardly relative to the base plate 21. The elastic element 203 is arranged between the keycap 201 and the membrane circuit board 22. Moreover, the elastic element 203 comprises a contacting part 2031.

The first connecting element 2021 comprises a first inner frame 20211 and a first outer frame 20212. The first outer frame 20212 is pivotally coupled to the first inner frame

20211. The first inner frame 20211 and the first outer frame 20212 are collaboratively formed as an X-shape structure. The second connecting element 2022 comprises a second inner frame 20221 and a second outer frame 20222. The second outer frame 20222 is pivotally coupled to the second inner frame 20221. The second inner frame 20221 and the second outer frame 20222 are collaboratively formed as an X-shape structure.

The keycap 201 comprises a first fixed hook 2011 and a first movable hook 2012 corresponding to the first connecting element 2021, and comprises a second fixed hook 2013 and a second movable hook 2014 corresponding to the second connecting element 2022. The first fixed hook 2011, the first movable hook 2012, the second fixed hook 2013 and the second movable hook 2014 are formed on a bottom surface of the keycap 201. The base coupling structures 213 comprises a first base hook 2131 and a second base hook 2132 corresponding to the first connecting element 2021, and comprises a third base hook 2133 and a fourth base hook 2134 corresponding to the second connecting element 2022.

The first end 202111 of the first inner frame 20211 of the first connecting element 2021 is pivotally coupled to the first fixed hook 2011 of the keycap 201. The second end 202112 of the first inner frame 20211 of the first connecting element 2021 is pivotally coupled to the second base hook 2132 of the base plate 21. The first end 202121 of the first outer frame 20212 of the first connecting element 2021 is connected with the first base hook 2131 of the base plate 21. The second end 202122 of the first outer frame 20212 of the first connecting element 2021 is slidably connected with the first movable hook 2012 of the keycap 201. The first end 202211 of the second inner frame 20221 of the second connecting element 2022 is pivotally coupled to the second fixed hook 2013 of the keycap 201. The second end 202212 of the second inner frame 20221 of the second connecting structure 2022 is pivotally coupled to the fourth base hook 2134 of the base plate 21. The first end 202221 of the second outer frame 20222 of the second connecting element 2022 is connected with the third base hook 2133 of the base plate 21. The second end 202222 of the second outer frame 20222 of the second connecting element 2022 is slidably connected with the second movable hook 2014 of the keycap 201.

Due to above design, the first inner frame 20211 and the first outer frame 20212 of the first connecting element 2021 can be swung relative to each other. That is, the first inner frame 20211 and the first outer frame 20212 are switched from a stacked state to an open-scissors state or switched from the open-scissors state to the stacked state. Similarly, the second inner frame 20221 and the second outer frame 20222 of the second connecting element 2022 can be swung relative to each other. That is, the second inner frame 20221 and the second outer frame 20222 are switched from the stacked state to the open-scissors state or switched from the open-scissors state to the stacked state.

While the keycap 201 of any key 20' is depressed and moved downwardly relative to the base plate 21, the first connecting element 2021 and the second connecting element 2022 are switched from the open-scissors state to the stacked state. Moreover, as the keycap 201 is moved downwardly to compress the elastic element 203, the corresponding membrane switch 221 is pushed and triggered by the contacting part 2031 of the elastic element 203. Consequently, the keyboard device 2 generates a corresponding key signal. When the keycap 201 of the key 20' is no longer depressed, the keycap 201 is moved upwardly relative to the base plate 21 in response to an elastic force of the elastic element 203. Meanwhile, the first connecting element 2021 and the second connecting element 2022 are switched from the stacked state to the open-scissors state again, and the keycap 201 is returned to its original position. It is noted that the connecting relationship between the connecting assembly 202, the base plate 21 and the keycap 201 is not restricted.

Moreover, the length L2 of the key 20' is much larger than the width W2 of the key 20'. The key 20' further comprises a first stabilizer bar 204 and a second stabilizer bar 205. The first stabilizer bar 204 and the second stabilizer bar 205 are connected between the keycap 201 and the connecting assembly 202. The first stabilizer bar 204 comprises a first transverse bar part 2040, a first hook part 2041 and a second hook part 2042. The first hook part 2041 and the second hook part 2042 are located at two ends of the first transverse bar part 2040, respectively. The second stabilizer bar 205 comprises a second transverse bar part 2050, a third hook part 2051 and a fourth hook part 2052. The third hook part 2051 and the fourth hook part 2052 are located at two ends of the second transverse bar part 2050, respectively. In an embodiment, the keycap 201 comprises plural first keycap connecting parts 2015 and plural second keycap connecting parts 2016. The first keycap connecting parts 2015 and the second keycap connecting parts 2016 are formed on the bottom surface of the keycap 201. The first transverse bar part 2040 of the first stabilizer bar 204 is pivotally coupled to the first keycap connecting part 2015 of the keycap 201. The second transverse bar part 2050 of the second stabilizer bar 205 is pivotally coupled to the second keycap connecting part 2016 of the keycap 201.

The first outer frame 20212 of the first connecting element 2021 further comprises a first sliding groove 20213 and a second sliding groove 20214. The first sliding groove 20213 and the second sliding groove 20214 are located at an outer surface and a middle region of the first outer frame 20212. The first hook part 2041 of the first stabilizer bar 204 and the third hook part 2051 of the second stabilizer bar 205 are slidably inserted into the first sliding groove 20213 and the second sliding groove 20214, respectively. The second outer frame 20222 of the second connecting element 2022 further comprises a third sliding groove 20223 and a fourth sliding groove 20224. The third sliding groove 20223 and the fourth sliding groove 20224 are located at an outer surface and a middle region of the second outer frame 20222. The second hook part 2042 of the first stabilizer bar 204 and the fourth hook part 2052 of the second stabilizer bar 205 are slidably inserted into the third sliding groove 20223 and the fourth sliding groove 20224, respectively.

While the keycap 201 of the key 20' is depressed and moved upwardly or downwardly relative to the base plate 21, the actions of the connecting assembly 202 are similar to those as mentioned above. In addition, the first transverse bar part 2040 of the first stabilizer bar 204 is rotated relative to the first keycap connecting parts 2015 of the keycap 201, and the first hook part 2041 and the second hook part 2042 of the first stabilizer bar 204 are respectively slid within the first sliding groove 20213 of the first outer frame 20212 and the third sliding groove 20223 of the second outer frame 20222. Similarly, the second transverse bar part 2050 of the second stabilizer bar 205 is rotated relative to the second keycap connecting parts 2016 of the keycap 201, and the third hook part 2051 and the fourth hook part 2052 of the second stabilizer bar 205 are respectively slid within the second sliding groove 20214 of the first outer frame 20212 and the fourth sliding groove 20224 of the second outer frame 20222. Consequently, the first stabilizer bar 204 and the second stabilizer bar 205 can be swung. By this design, the key 20' is kept stable and not inclined while the key 20' is moved upwardly or downwardly relative to the base plate 21. Preferably but not exclusively, the first stabilizer bar 204 and the second stabilizer bar 205 are made of metallic material, and the first connecting element 2021 and the second connecting element 2022 are made of plastic material. Consequently, this design is helpful to enhance the strength of the keyboard device 2 and increase the noise reduction efficacy of operating the key 20'.

Figure 11:
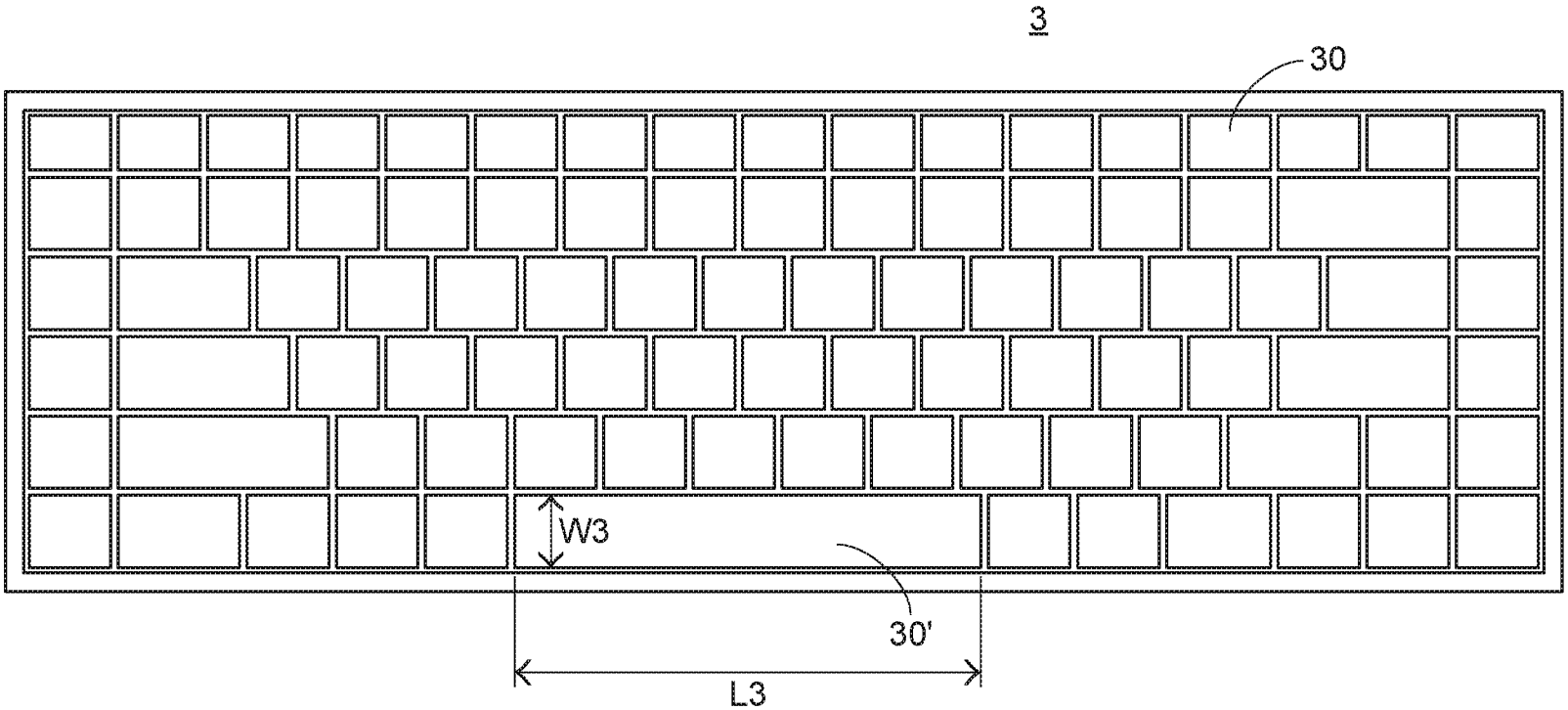
FIG. 11 is a schematic top view illustrating the outer appearance of a keyboard device according to a second embodiment of the present invention.
Figure 12:
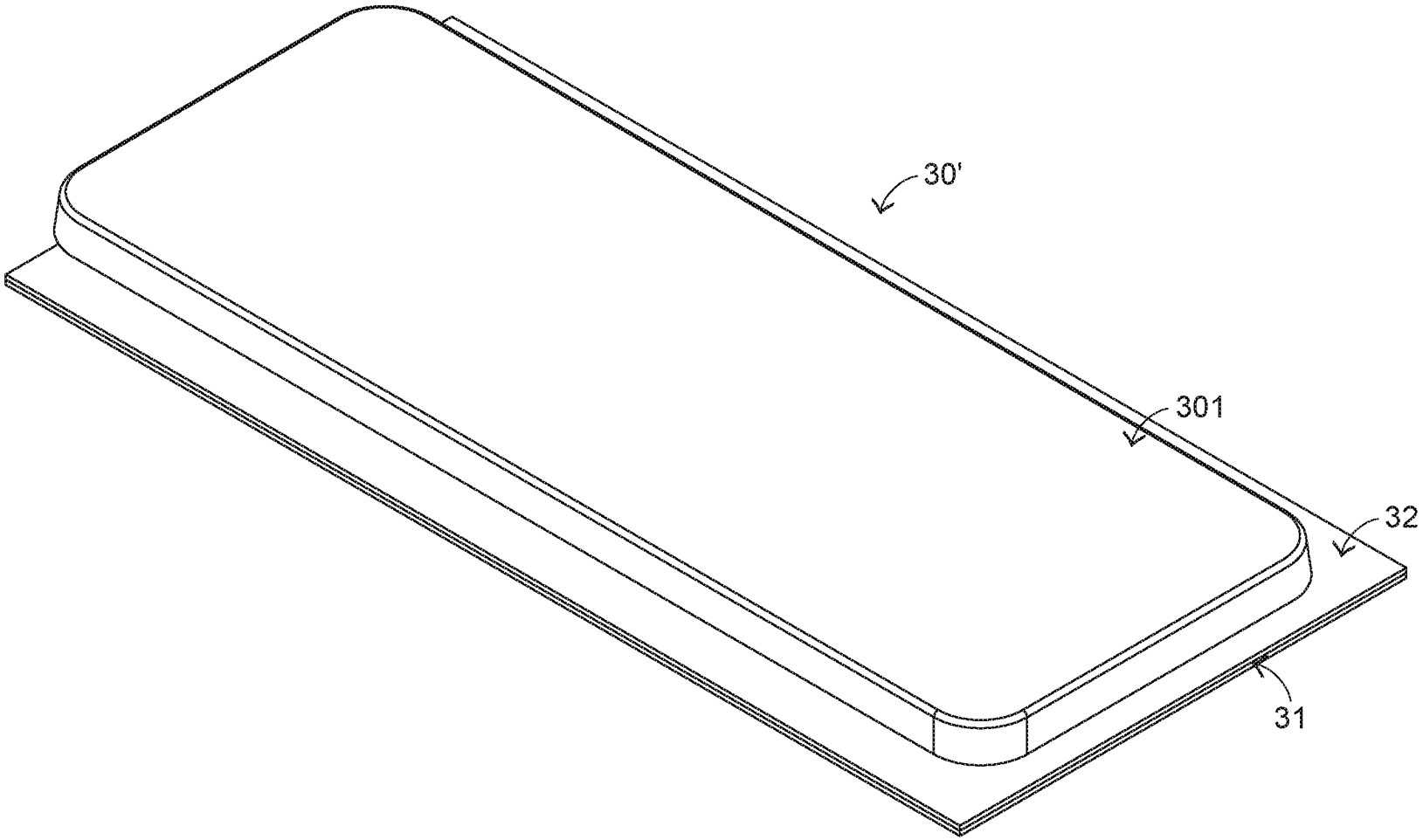
FIG. 12 is a schematic perspective view illustrating the appearance of a key, a base plate and a membrane circuit board of the keyboard device as shown in FIG. 11.
Figure 13:
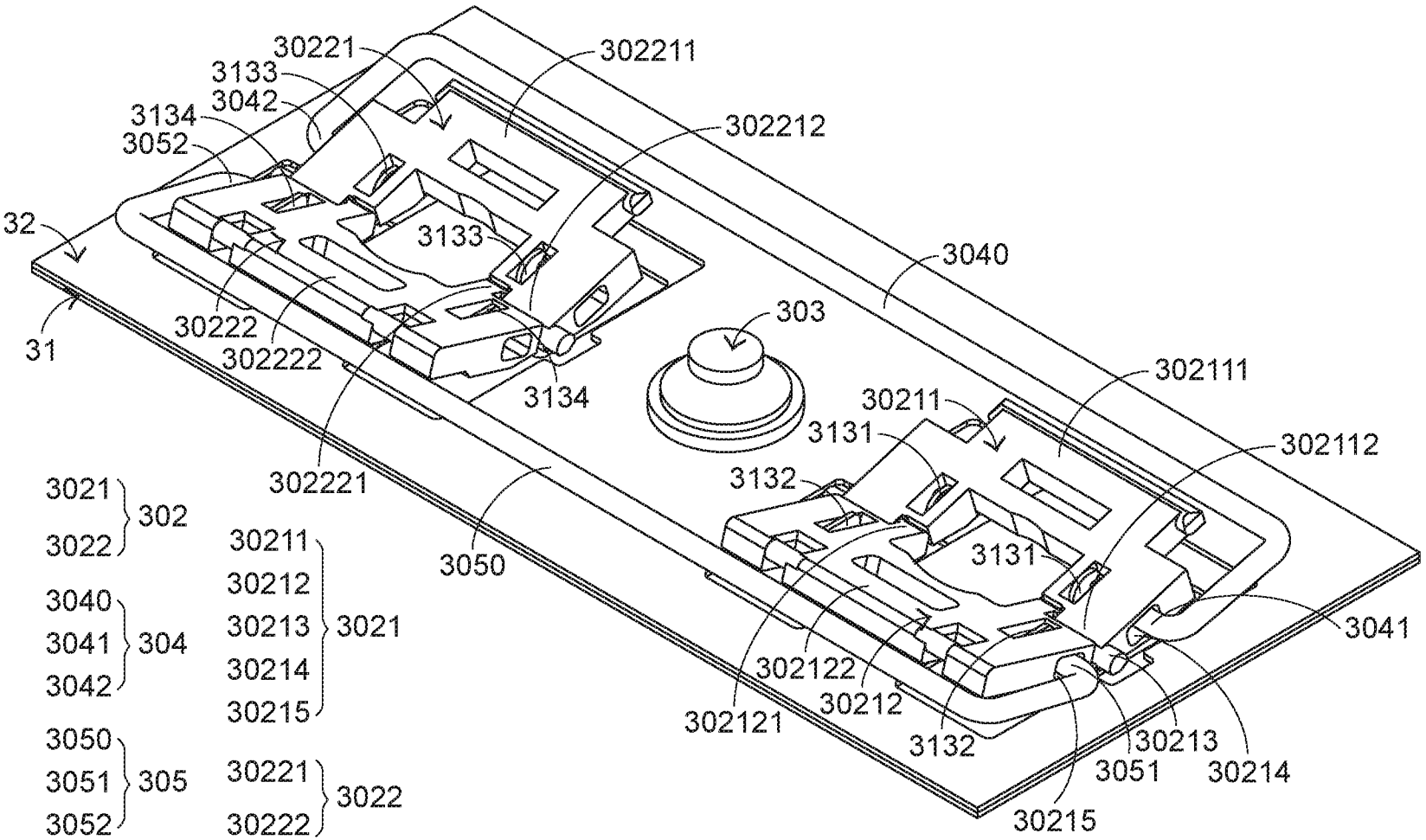
FIG. 13 is a schematic perspective view illustrating portions of the key, the base plate and the membrane circuit board of the keyboard device as shown in FIG. 12 and taken along a viewpoint.
Figure 14:
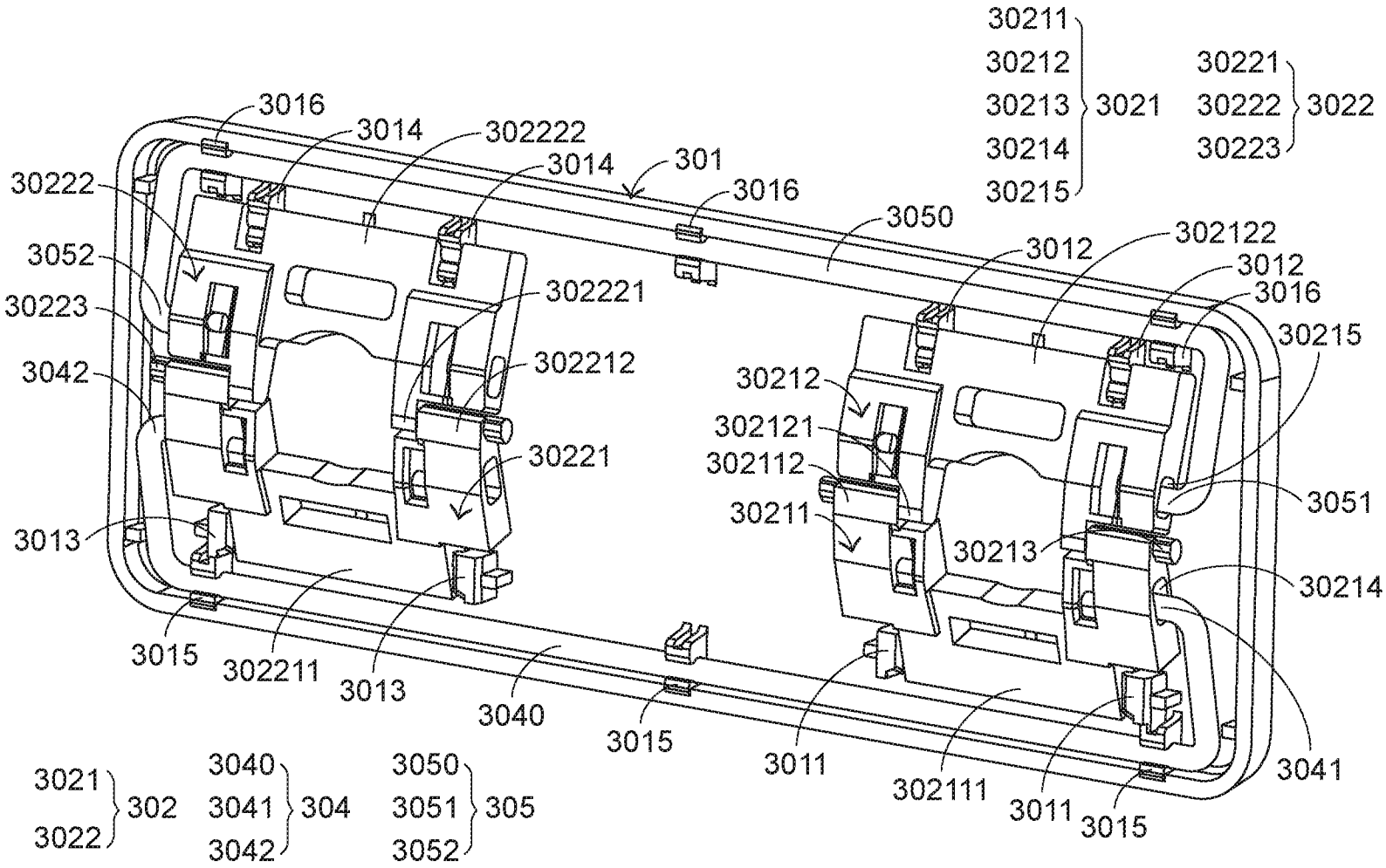
FIG. 14 is a schematic perspective view illustrating a portion of the key of the keyboard device as shown in FIG. 12 and taken along a viewpoint.
Figure 15:
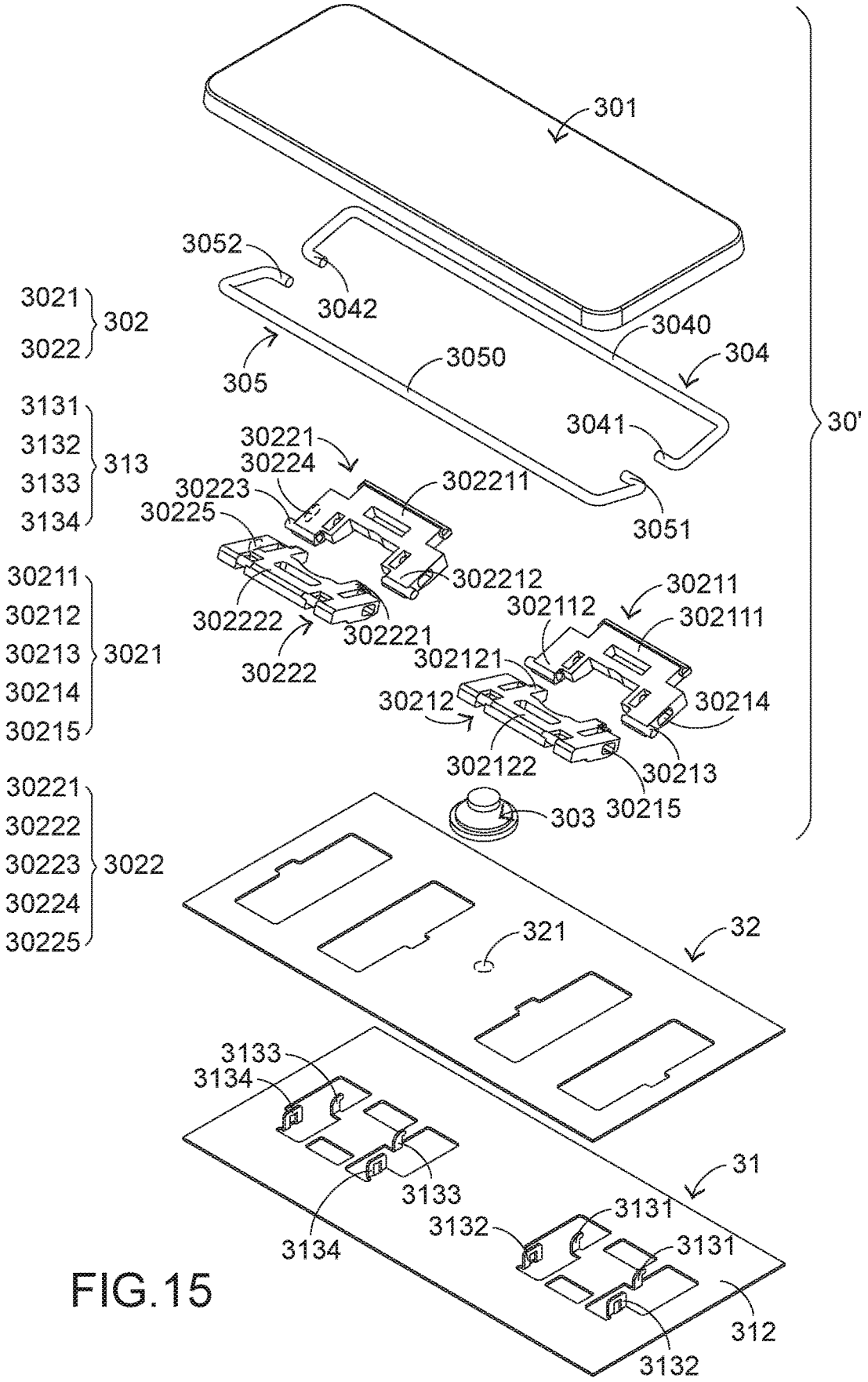
FIG. 15 is a schematic exploded view illustrating portions of the key, the base plate and the membrane circuit board of the keyboard device as shown in FIG. 12 and taken along a viewpoint.
Figure 16:
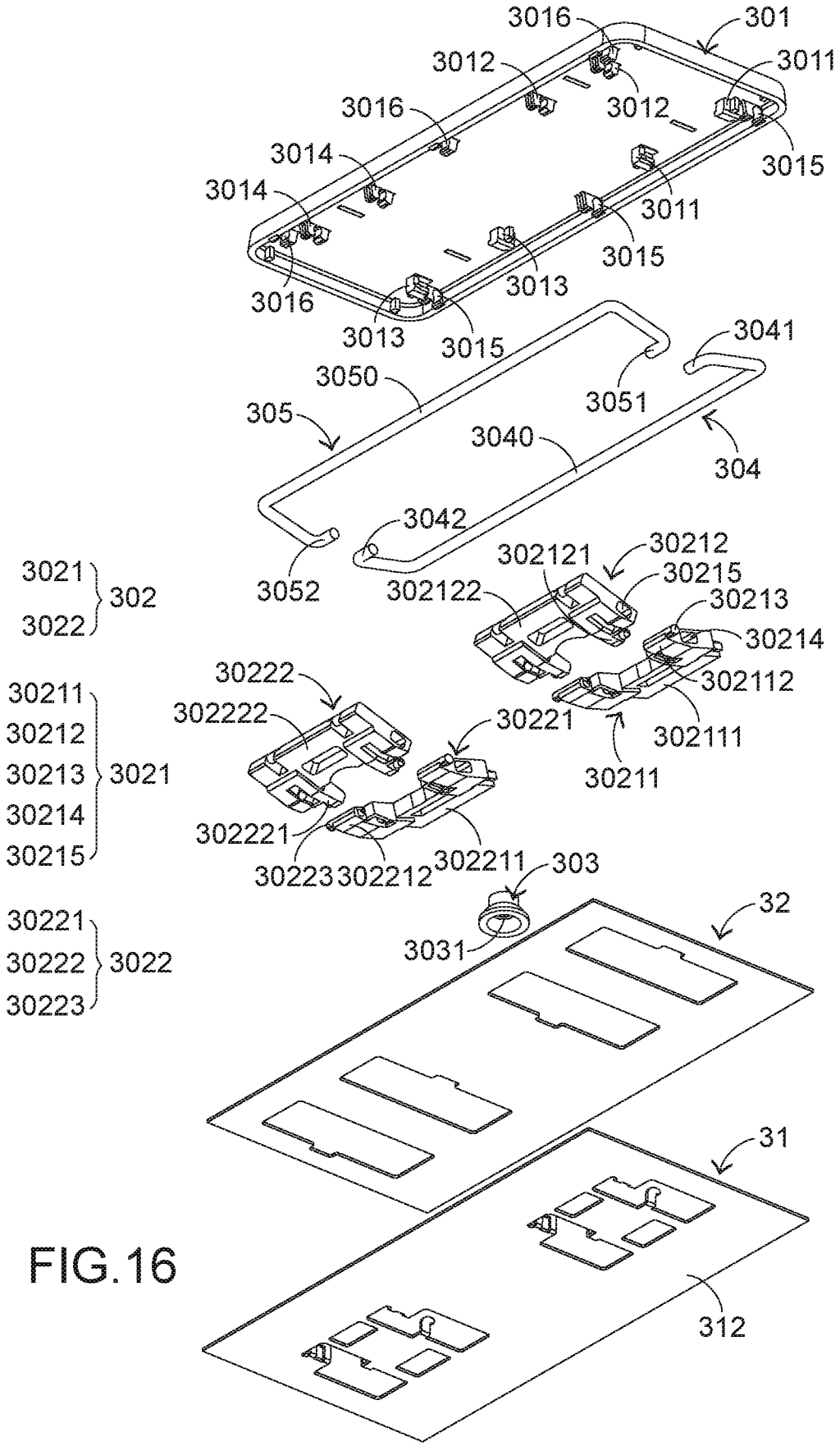
FIG. 16 is a schematic exploded view illustrating portions of the key, the base plate and the membrane circuit board of the keyboard device as shown in FIG. 15 and taken along another viewpoint.

Please refer to FIGS. 11, 12, 13, 14, 15 and 16. FIG. 11 is a schematic top view illustrating the outer appearance of a keyboard device according to a second embodiment of the present invention. FIG. 12 is a schematic perspective view illustrating the appearance of a key, a base plate and a membrane circuit board of the keyboard device as shown in FIG. 11. FIG. 13 is a schematic perspective view illustrating portions of the key, the base plate and the membrane circuit board of the keyboard device as shown in FIG. 12 and taken along a viewpoint. FIG. 14 is a schematic perspective view illustrating a portion of the key of the keyboard device as shown in FIG. 12 and taken along a viewpoint. FIG. 15 is a schematic exploded view illustrating portions of the key, the base plate and the membrane circuit board of the keyboard device as shown in FIG. 12 and taken along a viewpoint. FIG. 16 is a schematic exploded view illustrating portions of the key, the base plate and the membrane circuit board of the keyboard device as shown in FIG. 15 and taken along another viewpoint. For succinctness, only one key 30' and related components are shown in FIGS. 12, 13, 14, 15 and 16.

The keyboard device 3 comprises plural keys 30 and 30', a base plate 31 and a membrane circuit board 32. The membrane circuit board 32 is arranged between the plural keys 30, 30' and the base plate 31. These keys 30 and 30' are classified into some types, e.g., ordinary keys, numeric keys and function keys. When one of the keys 30 and 30' is depressed by the user's finger, the keyboard device 3 generates a corresponding key signal to a computer (not show), and thus the computer executes a function corresponding to the depressed key. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

The base plate 31 comprises a plate body 312 and plural base coupling structures 313. The plate body 312 is located under the membrane circuit board 32. The base coupling structures 313 are protruded upwardly and penetrated through the membrane circuit board 32. The membrane circuit board 32 comprises plural membrane switches 331 corresponding to the keys 30 and 30'.

Each key 30' comprises a keycap 301, a connecting assembly 302 and an elastic element 303. The connecting assembly 302 comprises a first connecting element 3021 and a second connecting element 3022, which are discretely arranged. The first connecting element 3021 and the second connecting element 3022 are connected between the keycap 301 and the base coupling structures 313. Through the connecting assembly 302, the keycap 301 is moved upwardly or downwardly relative to the base plate 31. The elastic element 303 is arranged between the keycap 301 and the membrane circuit board 32. Moreover, the elastic element 303 comprises a contacting part 3031.

The first connecting element 3021 comprises a first swingable frame 30211, a second swingable frame 30212 and a first supporting shaft 30213. The first end 302121 of the second swingable frame 30212 and the second end 302112 of the first swingable frame 30211 are pivotally coupled with each other. Consequently, the first swingable frame 30211 and the second swingable frame 30212 are collaboratively formed as a V-shape structure. The first supporting shaft 30213 is protruded from an outer surface of the second end 302112 of the first swingable frame 30211. The second connecting element 3022 comprises a third swingable frame 30221, a fourth swingable frame 30222 and a second supporting shaft 30223. The first end 302221 of the fourth swingable frame 30222 and the second end 302212 of the third swingable frame 30221 are pivotally coupled with each other. Consequently, the third swingable frame 30221 and the fourth swingable frame 30222 are collaboratively formed as a V-shape structure. The second supporting shaft 30223 is protruded from an outer surface of the second end 302212 of the third swingable frame 30221. When the keycap 301 is not depressed, the first supporting shaft 3021 of the first connecting element 3021 and the second supporting shaft 30223 of the second connecting element 3022 are contacted with the plate body 312 of the base plate 31. It is noted that the positions of the first supporting shaft and the second supporting shaft are not restricted. For example, in another embodiment, the first supporting shaft is protruded from an outer surface of the first end of the second swingable frame, and the second supporting shaft is protruded from an outer surface of the first end of the fourth swingable frame.

The keycap 301 comprises a first movable hook 3011, a first fixed hook 3012, a second movable hook 3013 and a second fixed hook 3014 corresponding to the first swingable frame 30211, the second swingable frame 30212, the third swingable frame 30221 and the fourth swingable frame 30222, respectively. The first movable hook 3011, the first fixed hook 3012, the second movable hook 3013 and the second fixed hook 3014 are formed on a bottom surface of the keycap 301. The base coupling structures 313 comprises a first base hook 3131, a second base hook 3132, a third base hook 3133 and a fourth base hook 3134 corresponding to the first swingable frame 30211, the second swingable frame 30212, the third swingable frame 30221 and the fourth swingable frame 30222, respectively.

The first end 302111 of the first swingable frame 30211 of the first connecting element 3021 is slidably connected with the first movable hook 3011 of the keycap 301. The second end 302112 of the first swingable frame 30211 of the first connecting element 3021 is connected with the first base hook 3131 of the base plate 31. The first end 302121 of the second swingable frame 30212 of the first connecting element 3021 is connected with the second base hook 3132 of the base plate 31. The second end 302122 of the second swingable frame 30212 of the first connecting element 3021 is connected with the first fixed hook 3011 of the keycap 301. The first end 302211 of the third swingable frame 30221 of the second connecting element 3022 is slidably connected with the second movable hook 3013 of the keycap 301. The second end 302212 of the third swingable frame 30221 of the second connecting structure 3022 is connected with the third base hook 3133 of the base plate 31. The first end 302221 of the fourth swingable frame 30222 of the second connecting element 3022 is connected with the fourth base hook 3134 of the base plate 31. The second end 302222 of the fourth swingable frame 30222 of the second connecting element 3022 is pivotally coupled to the second fixed hook 3014 of the keycap 301.

Due to above design, the first swingable frame 30211 and the second swingable frame 30212 of the first connecting element 3021 can be swung relative to each other. Consequently, the angle between the first swingable frame 30211 and the second swingable frame 30212 can be increased or decreased. Similarly, the third swingable frame 30221 and the fourth swingable frame 30222 of the second connecting element 3022 can be swung relative to each other. Consequently, the angle between the third swingable frame 30221 and the fourth swingable frame 30222 can be increased or decreased.

While the keycap 301 of any key 30' is depressed and moved downwardly relative to the base plate 31, the angle between the first swingable frame 30211 and the second swingable frame 30212 of the first connecting element 3021 and the angle between the third swingable frame 30221 and the fourth swingable frame 30222 of the second connecting element 3022 are increased. In addition, the first supporting shaft 30213 of the first connecting element 3021 and the second supporting shaft 30223 of the second connecting element 3022 are ascended and separated from the plate body 312 of the base plate 31. Moreover, as the keycap 301 is moved downwardly to compress the elastic element 303, the corresponding membrane switch 321 is pushed and triggered by the contacting part 3031 of the elastic element 303. Consequently, the keyboard device 3 generates a corresponding key signal. When the keycap 301 of the key 30' is no longer depressed, the keycap 301 is moved upwardly relative to the base plate 31 in response to an elastic force of the elastic element 303. Consequently, the angle between the first swingable frame 30211 and the second swingable frame 30212 of the first connecting element 3021 and the angle between the third swingable frame 30221 and the fourth swingable frame 30222 of the second connecting element 3022 are decreased. In addition, the first supporting shaft 30213 of the first connecting element 3021 and the second supporting shaft 30223 of the second connecting element 3022 are descended and contacted with the plate body 312 of the base plate 31, and the keycap 301 is returned to its original position. It is noted that the connecting relationship between the connecting assembly 302, the base plate 31 and the keycap 301 is not restricted.

Moreover, the length L3 of the key 30' is much larger than the width W3 of the key 30'. The key 30' further comprises a first stabilizer bar 304 and a second stabilizer bar 305. The first stabilizer bar 304 and the second stabilizer bar 305 are connected between the keycap 301 and the connecting assembly 302. The first stabilizer bar 304 comprises a first transverse bar part 3040, a first hook part 3041 and a second hook part 3042. The first hook part 3041 and the second hook part 3042 are located at two ends of the first transverse bar part 3040, respectively. The second stabilizer bar 305 comprises a second transverse bar part 3050, a third hook part 3051 and a fourth hook part 3052. The third hook part 3051 and the fourth hook part 3052 are located at two ends of the second transverse bar part 3050, respectively. In an embodiment, the keycap 301 comprises plural first keycap connecting parts 3015 and plural second keycap connecting parts 3016. The first keycap connecting parts 3015 and the second keycap connecting parts 3016 are formed on the bottom surface of the keycap 301. The first transverse bar part 3040 of the first stabilizer bar 304 is pivotally coupled to the first keycap connecting part 3015 of the keycap 301. The second transverse bar part 3050 of the second stabilizer bar 305 is pivotally coupled to the second keycap connecting part 3016 of the keycap 301.

The outer surface of the second end 302112 of the first swingable frame 30211 has a first sliding groove 30214. The first hook part 3041 of the first stabilizer bar 304 is slidably inserted into the first sliding groove 30214. The outer surface of the second end of the third swingable frame 30221 has a third sliding groove 30224. The second hook part 3042 of the first stabilizer bar 304 is slidably inserted into the third sliding groove 30224. The outer surface of the first end 302121 of the second swingable frame 30212 has a second sliding groove 30215. The third hook part 3051 of the second stabilizer bar 305 is slidably inserted into the second sliding groove 30215. The outer surface of the first end 302221 of the fourth swingable frame 30222 has a fourth sliding groove 30225. The fourth hook part 3052 of the second stabilizer bar 305 is slidably inserted into the fourth sliding groove 30225.

While the keycap 301 of the key 30' is depressed and moved upwardly or downwardly relative to the base plate 31, the actions of the connecting assembly 302 are similar to those as mentioned above. In addition, the first transverse bar part 3040 of the first stabilizer bar 304 is rotated relative to the first keycap connecting parts 3015 of the keycap 301, and the first hook part 3041 and the second hook part 3042 of the first stabilizer bar 304 are respectively slid within the first sliding groove 30214 of the first swingable frame 30211 and the third sliding groove 30224 of the third swingable frame 30221. Similarly, the second transverse bar part 3050 of the second stabilizer bar 305 is rotated relative to the second keycap connecting parts 3016 of the keycap 301, and the third hook part 3051 and the fourth hook part 3052 of the second stabilizer bar 305 are respectively slid within the second sliding groove 30215 of the second swingable frame 30212 and the fourth sliding groove 30225 of the fourth swingable frame 30222. Consequently, the first stabilizer bar 304 and the second stabilizer bar 305 can be swung. By this design, the key 30' is kept stable and not inclined while the key 30' is moved upwardly or downwardly relative to the base plate 31. Preferably but not exclusively, the first stabilizer bar 304 and the second stabilizer bar 305 are made of metallic material, and the first connecting element 3021 and the second connecting element 3022 are made of plastic material. Consequently, this design is helpful to enhance the strength of the keyboard device 3 and increase the noise reduction efficacy of operating the key 30'

From the above descriptions, the present invention provides the keyboard device. The stabilizer bars of the key are connected between the keycap and the connecting assembly. Since the stabilizer bars do not readily collide with or knock on the plate body and the base coupling structure of the base plate, the generated noise is reduced during the process of operating the key. Consequently, the operating comfort to the user is enhanced. In comparison with the conventional keyboard device, the base plate of the keyboard device of the present invention can be manufacture and assembled more easily.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a membrane circuit board comprising a membrane switch;

a base plate; and a key comprising:

a keycap located over the membrane circuit board, wherein when the keycap is moved downwardly relative to the membrane circuit board, the membrane switch is triggered;

a connecting assembly connected between the keycap and the base plate, wherein the connecting assembly comprises a first connecting element and a second connecting element, which are discretely arranged, wherein the first connecting element comprises a first inner frame and a first outer frame, and the second connecting element comprises a second inner frame and a second outer frame, wherein the first outer frame is pivotally coupled to the first inner frame, the first inner frame and the first outer frame are collaboratively formed as a first X-shape structure, the second outer frame is pivotally coupled to the second inner frame, and the second inner frame and the second outer frame are collaboratively formed as a second X-shape structure, wherein while the keycap is moved upwardly or downwardly relative to the membrane circuit board, the first inner frame and the first outer frame are swung relative to each other, and the second inner frame and the second outer frame are swung relative to each other;

a first stabilizer bar connected between the keycap and the connecting assembly, wherein the first stabilizer bar comprises a first transverse bar part, a first hook part and a second hook part, and the first hook part and the second hook part are respectively located at two ends of the first transverse bar part; and a second stabilizer bar connected between the keycap and the connecting assembly, wherein the second stabilizer bar comprises a second transverse bar part, a third hook part and a fourth hook part, and the third hook part and the fourth hook part are respectively located at two ends of the second transverse bar part, wherein the first transverse bar part and the second transverse bar part are connected with the keycap, the first hook part and the third hook part are connected with the first connecting element, and the second hook part and the fourth hook part are connected with the second connecting element, wherein the first hook part and the third hook part are connected with the first outer frame, and the second hook part and the fourth hook part are connected with the second outer frame, wherein while the keycap is moved upwardly or downwardly relative to the membrane circuit board, the first stabilizer bar and the second stabilizer are swung to stabilize the key.

2. The keyboard device according to claim 1, wherein the first outer frame further comprises a first sliding groove and a second sliding groove, the second outer frame further comprises a third sliding groove and a fourth sliding groove, and the keycap comprises a first keycap connecting part and a second keycap connecting part, wherein the first sliding groove and the second sliding groove are located at an outer surface and a middle region of the first outer frame, and the first hook part and the third hook part are slidably inserted into the first sliding groove and the second sliding groove, respectively, wherein the third sliding groove and the fourth sliding groove are located at an outer surface and a middle region of the second outer frame, and the second hook part and the fourth hook part are slidably inserted into the third sliding groove and the fourth sliding groove, respectively, wherein the first transverse bar part is pivotally coupled to the first keycap connecting part, and the second transverse bar part is pivotally coupled to the second keycap connecting part.

3. A keyboard device, comprising:

a membrane circuit board comprising a membrane switch;

a base plate; and a key comprising:

a keycap located over the membrane circuit board, wherein when the keycap is moved downwardly relative to the membrane circuit board, the membrane switch is triggered;

a connecting assembly connected between the keycap and the base plate, wherein the connecting assembly comprises a first connecting element and a second connecting element, which are discretely arranged, wherein the first connecting element comprises a first inner frame and a first outer frame, and the second connecting element comprises a second inner frame and a second outer frame, wherein the first outer frame is pivotally coupled to the first inner frame, the first inner frame and the first outer frame are collaboratively formed as a first X-shape structure, the second outer frame is pivotally coupled to the second inner frame, and the second inner frame and the second outer frame are collaboratively formed as a second X-shape structure, wherein while the keycap is moved upwardly or downwardly relative to the membrane circuit board, the first inner frame and the first outer frame are swung relative to each other, and the second inner frame and the second outer frame are swung relative to each other;

a first stabilizer bar connected between the keycap and the connecting assembly, wherein the first stabilizer bar comprises a first transverse bar part, a first hook part and a second hook part, and the first hook part and the second hook part are respectively located at two ends of the first transverse bar part; and a second stabilizer bar connected between the keycap and the connecting assembly, wherein the second stabilizer bar comprises a second transverse bar part, a third hook part and a fourth hook part, and the third hook part and the fourth hook part are respectively located at two ends of the second transverse bar part, wherein the first transverse bar part and the second transverse bar part are connected with the keycap, the first hook part and the third hook part are connected with the first connecting element, and the second hook part and the fourth hook part are connected with the second connecting element, wherein while the keycap is moved upwardly or downwardly relative to the membrane circuit board, the first stabilizer bar and the second stabilizer are swung to stabilize the key, wherein the keycap comprises:

a first fixed hook pivotally coupled to a first end of the first inner frame;

a first movable hook slidably connected with a second end of the first outer frame;

a second fixed hook pivotally coupled to a first end of the second inner frame; and a second movable hook slidably connected with a second end of the second outer frame.

4. The keyboard device according to claim 1, wherein the base plate comprises a plate body and a base coupling structure, wherein the plate body is located under the membrane circuit board, and the base coupling structure is protruded upwardly and penetrated through the membrane circuit board, wherein the base coupling structure comprises:

a first base hook connected with a first end of the first outer frame;

a second base hook connected with a second end of the first inner frame;

a third base hook connected with a first end of the second outer frame; and a fourth base hook connected with a second end of the second inner frame.

5. The keyboard device according to claim 1, wherein the first connecting element comprises a first swingable frame and a second swingable frame, and the second connecting element comprises a third swingable frame and a fourth swingable frame, wherein the first swingable frame and the second swingable frame are collaboratively formed as a first V-shape structure, a first end of the second swingable frame and a second end of the first swingable frame are pivotally coupled with each other, the third swingable frame and the fourth swingable frame are collaboratively formed as a second V-shape structure, and a first end of the fourth swingable frame and a second end of the third swingable frame are pivotally coupled with each other, wherein when the keycap is moved upwardly or downwardly relative to the membrane circuit board, the first swingable frame and the second swingable frame are swung relative to each other and the third swingable frame and the fourth swingable frame are swung relative to each other.

6. A keyboard device, comprising:

a membrane circuit board comprising a membrane switch;

a base plate; and a key comprising:

a keycap located over the membrane circuit board, wherein when the keycap is moved downwardly relative to the membrane circuit board, the membrane switch is triggered;

a connecting assembly connected between the keycap and the base plate, wherein the connecting assembly comprises a first connecting element and a second connecting element, which are discretely arranged, wherein the first connecting element comprises a first swingable frame and a second swingable frame, and the second connecting element comprises a third swingable frame and a fourth swingable frame, wherein the first swingable frame and the second swingable frame are collaboratively formed as a first V-shape structure, a first end of the second swingably frame and a second end of the first swingably frame are pivotally coupled with each other, the third swingable frame and the fourth swingable frame are collaboratively formed as a second V-shape structure, and a first end of the fourth swingable frame and a second end of the third swingable frame are pivotally coupled with each other, wherein when the keycap is moved upwardly or downwardly relative to the membrane circuit board, the first swingably frame and the second swingable frame are swung relative to each other and the third swingable frame and the fourth swingably frame are swung relative to each other;

a first stabilizer bar connected between the keycap and the connecting assembly, wherein the first stabilizer bar comprises a first transverse bar part, a first hook part and a second hook part, and the first hook part and the second hook part are respectively located at two ends of the first transverse bar part; and a second stabilizer bar connected between the keycap and the connecting assembly, wherein while the keycap is moved upwardly or downwardly relative to the membrane circuit board, the first stabilizer bar and the second stabilizer are swung to stabilize the key, wherein the second stabilizer bar comprises a second transverse bar part, a third hook part and a fourth hook part, and the third hook part and the fourth hook part are respectively located at two ends of the second transverse bar part, wherein the first transverse bar part and the second transverse bar part are connected with the keycap, the first hook part and the third hook part are connected with the first connecting element, and the second hook part and the fourth hook part are connected with the second connecting element, wherein the first hook part is connected with the first swingable frame, the second hook part is connected with the third swingable frame, the third hook part is connected with the second swingable frame, and the fourth hook part is connected with the fourth swingable frame.

7. The keyboard device according to claim 6, wherein an outer surface of the second end of the first swingable frame has a first sliding groove, and the first hook part is slidably inserted into the first sliding groove, wherein an outer surface of the second end of the third swingable frame has a third sliding groove, and the second hook part is slidably inserted into the third sliding groove, wherein an outer surface of the first end of the second swingable frame has a second sliding groove, and the third hook part is slidably inserted into the second sliding groove, wherein an outer surface of the first end of the fourth swingable frame has a fourth sliding groove, and the fourth hook part is slidably inserted into the fourth sliding groove, wherein the keycap comprises a first keycap connecting part and a second keycap connecting part, and the first keycap connecting part and the second keycap connecting part are pivotally coupled to the first transverse bar part and the second transverse bar part, respectively.

8. The keyboard device according to claim 5, wherein the keycap comprises:

a first movable hook slidably connected with a first end of the first swingable frame;

a first fixed hook pivotally coupled to a second end of the second swingable frame;

a second movable hook slidably connected with a first end of the third swingable frame; and a second fixed hook pivotally coupled to a second end of the fourth swingable frame.

9. The keyboard device according to claim 5, wherein the base plate comprises a plate body and a base coupling structure, wherein the plate body is located under the membrane circuit board, and the base coupling structure is protruded upwardly and penetrated through the membrane circuit board, wherein the base coupling structure comprises:

a first base hook connected with the second end of the first swingable frame;

a second base hook connected with the first end of the second swingable frame;

a third base hook connected with the second end of the third swingable frame; and a fourth base hook connected with the first end of the fourth swingable frame.

10. The keyboard device according to claim 5, wherein the first connecting element further comprises a first supporting shaft, and the first supporting shaft is protruded from an outer surface of the second end of the first swingable frame or protruded from an outer surface of the first end of the second swingable frame, wherein the second connecting element further comprises a second supporting shaft, and the second supporting shaft is protruded from an outer surface of the second end of the third swingable frame or protruded from an outer surface of the first end of the fourth swingable frame, wherein when the keycap is not depressed, the first supporting shaft and the second supporting shaft are contacted with the base plate, wherein when the keycap is depressed, the first supporting shaft and the second supporting shaft are ascended and separated from the base plate.

11. The keyboard device according to claim 1, wherein the key further comprises an elastic element, and the elastic element is connected between the keycap and the membrane circuit board and comprises a contacting part, wherein while the keycap is depressed, the elastic element is compressed and the membrane switch is pushed by the contacting part, wherein when the keycap is not depressed, the keycap is returned to an original position in response to an elastic force provided by the elastic element.

* * * * *